US010085528B2

(12) United States Patent
Wong

(10) Patent No.: US 10,085,528 B2
(45) Date of Patent: Oct. 2, 2018

(54) CLASP, WATCH BAND, AND WATCH

(71) Applicant: SEIKO EPSON CORPORATION, Tokyo (JP)

(72) Inventor: Choi hung Wong, Hong Kong (CN)

(73) Assignee: Seiko Epson Corporation, Tokyo (JP)

( * ) Notice: Subject to any disclaimer, the term of this patent is extended or adjusted under 35 U.S.C. 154(b) by 118 days.

(21) Appl. No.: 15/286,873

(22) Filed: Oct. 6, 2016

(65) Prior Publication Data

US 2017/0215531 A1 Aug. 3, 2017

(30) Foreign Application Priority Data

Jan. 29, 2016 (CN) ..... 2016 1 0064468

(51) Int. Cl.
*A44C 5/24* (2006.01)
*A44C 5/02* (2006.01)
*A44C 5/22* (2006.01)

(52) U.S. Cl.
CPC ..... *A44C 5/246* (2013.01); *A44C 5/027* (2013.01); *A44C 5/22* (2013.01); *Y10T 24/2155* (2015.01); *Y10T 24/4782* (2015.01)

(58) Field of Classification Search
CPC ..... A44C 5/246; A44C 5/22; A44C 5/027; A44C 5/24; A44C 5/2052; Y10T 24/4782; Y10T 24/2155; Y10T 24/4745; Y10T 24/2166; Y10T 24/2164
See application file for complete search history.

(56) References Cited

U.S. PATENT DOCUMENTS 3,696,469 A * 10/1972 Kalinsky ..... A44C 5/246 24/71 J
4,424,611 A * 1/1984 Mori ..... A44C 5/246 24/192
5,305,503 A * 4/1994 Yamagata ..... A44C 5/24 24/265 WS
5,485,659 A * 1/1996 Kashikie ..... A44C 5/2052 24/265 WS
5,787,554 A * 8/1998 Hashimoto ..... A44C 5/185 24/265 WS
6,023,816 A * 2/2000 Okada ..... A44C 5/24 24/265 WS
6,311,373 B1 11/2001 Hashimoto
6,434,798 B1 * 8/2002 Yamakawa ..... A44C 5/24 24/265 WS (Continued)

FOREIGN PATENT DOCUMENTS

JP 2000-245512 A 9/2000

*Primary Examiner* — Robert Sandy
*Assistant Examiner* — Rowland Do

(57) ABSTRACT

A clasp includes a lower holding member in which a lock pin is fixed, an upper holding member which is pivotably interlocked with the lower holding member, a lifting member which is attached to the lower holding member so as to be able to move in a lifting direction and a lowering direction and guides a first band, a lock member which is attached to the lower holding member so as to be able to pivot between a lock position and an unlock position, and a main cover. The lock member lifts the lifting member to the lower holding member side when being pivoted to the lock position so as to perform positioning and fixing of the first band while interposing the first band therebetween.

18 Claims, 10 Drawing Sheets

(56) References Cited

U.S. PATENT DOCUMENTS

| | | | | |
|---|---|---|---|---|
| 6,457,216 | B1 * | 10/2002 | Lo | A44C 5/24<br>24/265 WS |
| 6,681,453 | B1 * | 1/2004 | Hashimoto | A44C 5/2052<br>24/265 BC |
| 2004/0083581 | A1 * | 5/2004 | Kawagoe | A44C 5/185<br>24/265 WS |
| 2012/0240361 | A1 * | 9/2012 | Leger | A44C 5/246<br>24/265 EC |
| 2015/0181988 | A1 * | 7/2015 | Kaltenrieder | A44C 5/24<br>63/3.2 |
| 2016/0081439 | A1 * | 3/2016 | Catanese | A44B 11/226<br>63/3.1 |
| 2016/0309859 | A1 * | 10/2016 | Catanese | A44C 5/24 |

* cited by examiner

CLASP, WATCH BAND, AND WATCH

BACKGROUND

1. Technical Field

The present invention relates to a clasp for a band such as a watch band and an accessory band, a watch band using the clasp, and a watch including the watch band.

2. Related Art

As a clasp of belt-like accessories such as a wristwatch band and a bracelet, a three-fold-type clasp is known (for example, refer to JP-A-2000-245512).

The three-fold-type clasp includes a main body portion and a folding portion. The main body portion includes a frame body, a pressing plate, a locking mechanism, and a front cover. The frame body includes a bottom plate and a pair of side walls. The pressing plate is provided so as to be movable in a band-thickness direction with respect to the bottom plate of the frame body. The front cover has a hook portion which engages with the locking mechanism.

The pressing plate is configured to have a spring leaf and a pressurizing plate in an overlapping manner, and a curved spring portion is formed in the spring leaf. When the hook portion is engaged with the locking mechanism, the hook portion pressurizes the spring portion.

The locking mechanism includes a pair of push-buttons, a pair of springs biasing the push-buttons, and a guide housing accommodating the push-buttons and the springs. The guide housing is fixed to side walls of the frame body.

The folding portion is configured to have an intermediate plate and a lower plate. An end portion of the lower plate is pivotably interlocked with the frame body, and a pressurizing projection is provided in the end portion. When a user causes the lower plate to pivot in a direction of being separated from the frame body, the tip of the pressurizing projection is separated from the pressing plate, and the pressing plate is released. Therefore, a band is inserted into a gap between the bottom plate and the pressing plate of the frame body, and the position of the main body portion with respect to the band can be adjusted.

When the user causes the lower plate to pivot in a direction approaching the frame body, the tip of the pressurizing projection pressurizes the pressing plate, and the pressing plate and the band are pressurized toward the bottom plate side. Accordingly, the frame body is fixed to the band. In this case, a side surface portion of the pressurizing projection comes into contact with the guide housing, thereby preventing a lower frame from pivoting beyond thereof.

Moreover, the user folds the intermediate plate toward the lower plate side and causes a spring rod of the intermediate plate to engage with the side walls of the frame body. Accordingly, the intermediate plate and the lower plate can engage with the frame body. The other band is interlocked with the intermediate plate, and the front cover is pivotably interlocked with the intermediate plate as well. The hook portion of the front cover is inserted into an insertion hole of the guide housing and is latched on engagement projections of the push-buttons, thereby being locked. In this case, the hook portion pressurizes the pressing plate via the spring portion and causes the pressing plate to be in press-contact with the band.

Accordingly, the user can adjust an attachment position of the main body portion with respect to the band and can adjust the effective length of the band.

However, in the aforementioned clasp, the main body portion is required to provide with a mechanism of adjusting the effective length of the band, and a mechanism of locking/unlocking the clasp. Accordingly, there are disadvantages such as the complicated structure of the main body portion, the increased number of components, and the increased weight.

SUMMARY

An advantage of some aspects of the invention is to provide a clasp in which the structure can be simplified, the number of components can be reduced, and the weight can be easily reduced; a watch band; and a watch.

A clasp according to an aspect of the invention causes a first band and a second band to be interlocked with each other. The clasp includes a lower holding member in which a lock pin is fixed, an upper holding member which is pivotably interlocked with the lower holding member, a lifting member which is attached to the lower holding member so as to be able to move in a lifting direction approaching the lower holding member and a lowering direction of being separated from the lower holding member and guides the first band, a lock member which is attached to the lower holding member so as to be able to pivot between a lock position and an unlock position and lifts the lifting member to the lower holding member side when being pivoted to the lock position so as to perform positioning and fixing of the first band while interposing the first band between the lifting member and the lower holding member, and a main cover which includes a lock mechanism engaged with the lock pin in a state where the upper holding member and the lower holding member overlap each other due to pivoting and is pivotably interlocked between the upper holding member and the second band.

According to the aspect of the invention, a mechanism in which the clasp is attached to the first band in a positionally adjustable manner is configured to include the lower holding member, the lifting member, and the lock member. A mechanism for locking/unlocking the clasp is configured to include the lock mechanism provided in the main cover, and the lock pin of the lower holding member. Thus, since it is not necessary to collectively provide the mechanisms in one main body portion, the structure of the clasp can be simplified and the number of components can be reduced. Since the number of components can be reduced, the clasp can be easily reduced in weight.

In the aspect of the invention, it is preferable that the lower holding member includes a lower plate portion and a pair of side plate portions, and a guide groove extending along the lifting direction is formed in each of the side plate portions. It is preferable that the lifting member includes a bottom plate portion which faces the lower plate portion, a pair of guide portions which are respectively disposed along the pair of side plate portions, and, a guide pin which is inserted through each of the guide grooves and is attached to the pair of guide portions. It is preferable that the lock member includes an operation portion which is pivotably supported by the guide pin, and a pressurizing portion which comes into contact with the lower plate portion and lifts the lifting member in the lifting direction when the operation portion is pivoted to the lock position, and the pressurizing portion is configured to be separated from the lower plate portion such that the lifting member becomes movable in the lowering direction when the operation portion is pivoted to the unlock position.

According to this configuration, the pair of side plate portions of the lower holding member are disposed between the pair of guide portions of the lifting member, and the lock member is disposed between the side plate portions. A mechanism for positioning and fixing the first band can be configured by inserting the guide pin through the guide portions, the guide grooves of the side plate portions, and the lock member. Thus, the number of components of the clasp can be reduced, and a manufacturing process of the clasp can also be easily performed.

The pressurizing portion is formed in the lock member, and the pressurizing portion is brought into contact with the lower plate portion by causing the operation portion of the lock member to pivot to the lock position. Accordingly, the guide pin and the lifting member move in the lifting direction, and the first band can be positioned and fixed while being interposed between the lifting member and the lower holding member. Therefore, the configuration of the lock member can be simplified, and the manufacturing cost can also be reduced. Moreover, the first band can be positioned and fixed or can be positionally adjusted by only causing the operation portion of the lock member to pivot between the lock position and the unlock position, and a length-adjustment operation of the watch band can be easily performed. Thus, since a user of a wristwatch can adjust the position of the clasp in person, the effective length of the band can also be easily adjusted to a length as the user desires.

In the aspect of the invention, it is preferable that the first band is configured to have a plurality of band pieces which are interlocked with each other. It is preferable that a positioning projection protruding toward the lower plate portion is formed in the bottom plate portion of the lifting member. It is preferable that the positioning projection is disposed between the band pieces when the lock member is pivoted to the lock position and the first band is interposed between the lifting member and the lower holding member.

According to this configuration, if a positioning projection is formed in the bottom plate portion, the positioning projection is disposed between the band pieces when the first band is interposed between the lifting member and the lower holding member. Thus, the first band can be reliably restricted from moving with respect to the clasp.

In the aspect of the invention, it is preferable that a guide projection protruding toward the side plate portion is formed in each of the pair of guide portions of the lifting member. It is preferable that the lifting member moves in the lifting direction and the lowering direction while the guide projections are respectively guided in the guide grooves.

According to this configuration, if a guide projection is formed in the guide portion, the guide projection can be disposed in the guide groove of the side plate portion. Therefore, the lifting member can be guided by the guide pin and the guide projections disposed in the guide grooves. Thus, when the lock member is pivoted, the lifting member can be prevented from pivoting in association with the lock member, and the lifting member can be smoothly moved in the lifting direction and the lowering direction.

In the aspect of the invention, it is preferable that the lower holding member has a penetration hole. It is preferable that the lock member overlaps the lower holding member and partially covers the penetration hole when being pivoted to the lock position.

According to this configuration, when the lock member is pivoted to the lock position, the lock member is disposed while overlapping the lower holding member and partially covers the penetration hole. Accordingly, an end portion of the lock member is exposed through the penetration hole portion. Therefore, the lock member can be raised by inserting a finger or a nail into the penetration hole portion, or the lock member can be pivoted by inserting a pin or the like through the penetration hole and pressing the rear surface side of the projection portion. Thus, a pivoting operation of the lock member can be easily performed.

In the aspect of the invention, it is preferable that the lower holding member has a penetration hole. It is preferable that the lock member has a projection portion which partially overlaps the penetration hole when being pivoted to the lock position. It is preferable that the upper holding member has a recessed portion which is formed on a surface facing the lower holding member. It is preferable that the projection portion is disposed in the recessed portion when the lower holding member and the upper holding member overlap each other due to pivoting.

According to this configuration, if a recessed portion is formed in the upper holding member, the recessed portion can be used as a bead for reinforcing the plate material so that rigidity of the upper holding member can be improved. Since the recessed portion in which the projection portion can be disposed is formed in the upper holding member, a gap can be prevented from being generated when the lower holding member and the upper holding member overlap each other due to pivoting. Thus, rigidity of the clasp can be improved.

A watch band according to another aspect of the invention includes the clasp, a first band which is positioned and fixed by the lower holding member and the lifting member of the clasp, and a second band which is interlocked with the main cover.

A watch according to still another aspect of the invention includes the watch band.

According to these aspects of the invention, since the above-described clasp is included, the above-described effect is achieved, the structure of the clasp can be simplified, the number of components can be reduced, and the clasp can be reduced in weight. Thus, the watch band can also be reduced in weight and can be applied to watches of various types.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings.

Figure 1:
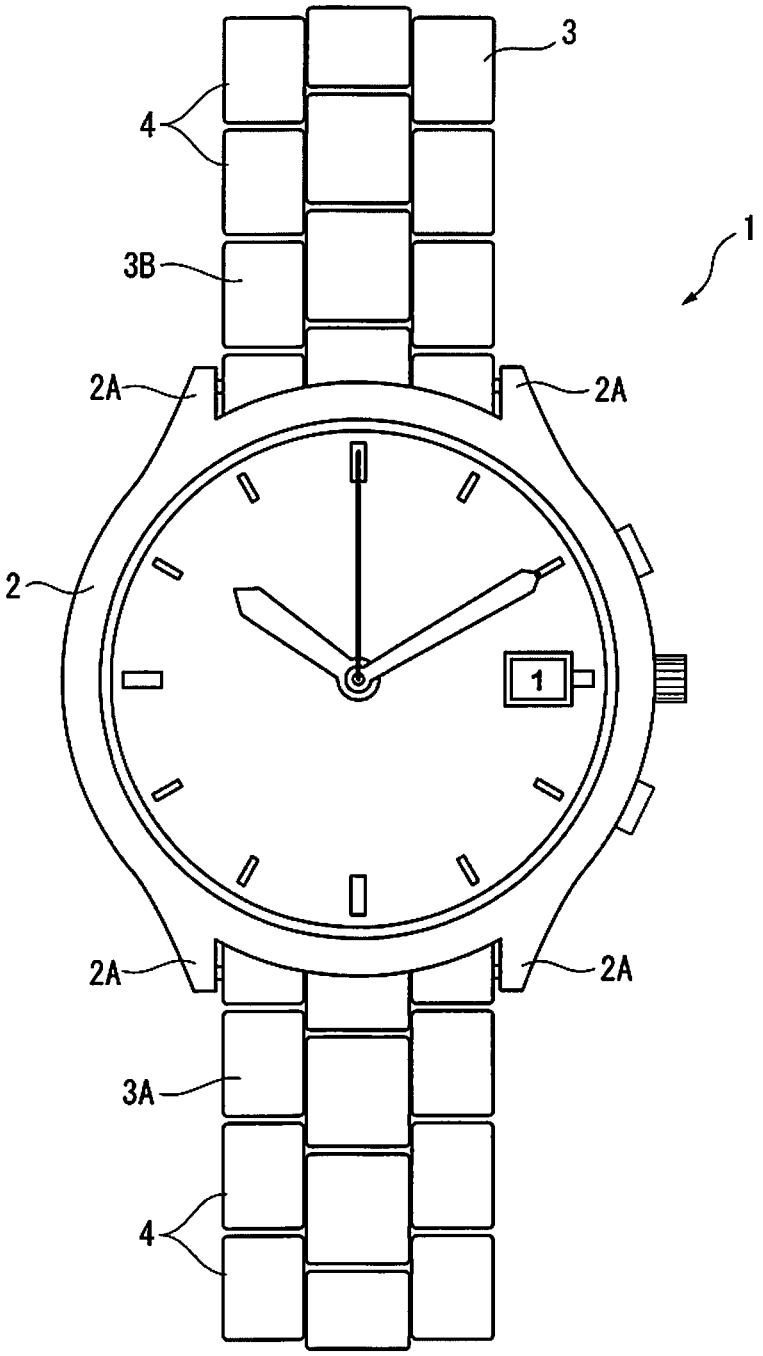
FIG. 1 is a front view illustrating a wristwatch using a watch band of an embodiment of the invention.

As illustrated in FIG. 1, a wristwatch 1 includes an outer case 2 and a watch band 3. Lags 2A are integrally provided in each of the six o'clock direction and the twelve o'clock direction of the outer case 2. The watch band 3 has a first band 3A on the six o'clock side and a second band 3B on the twelve o'clock side, which are respectively interlocked with the lags 2A.

The first band 3A and the second band 3B are configured to include a plurality of band pieces 4 which are interlocked with each other with pins (not illustrated).

Open end portions of the first band 3A and the second band 3B are fastened to a clasp 10 of the embodiment of the invention illustrated in FIGS. 2 to 6.

Figure 5:
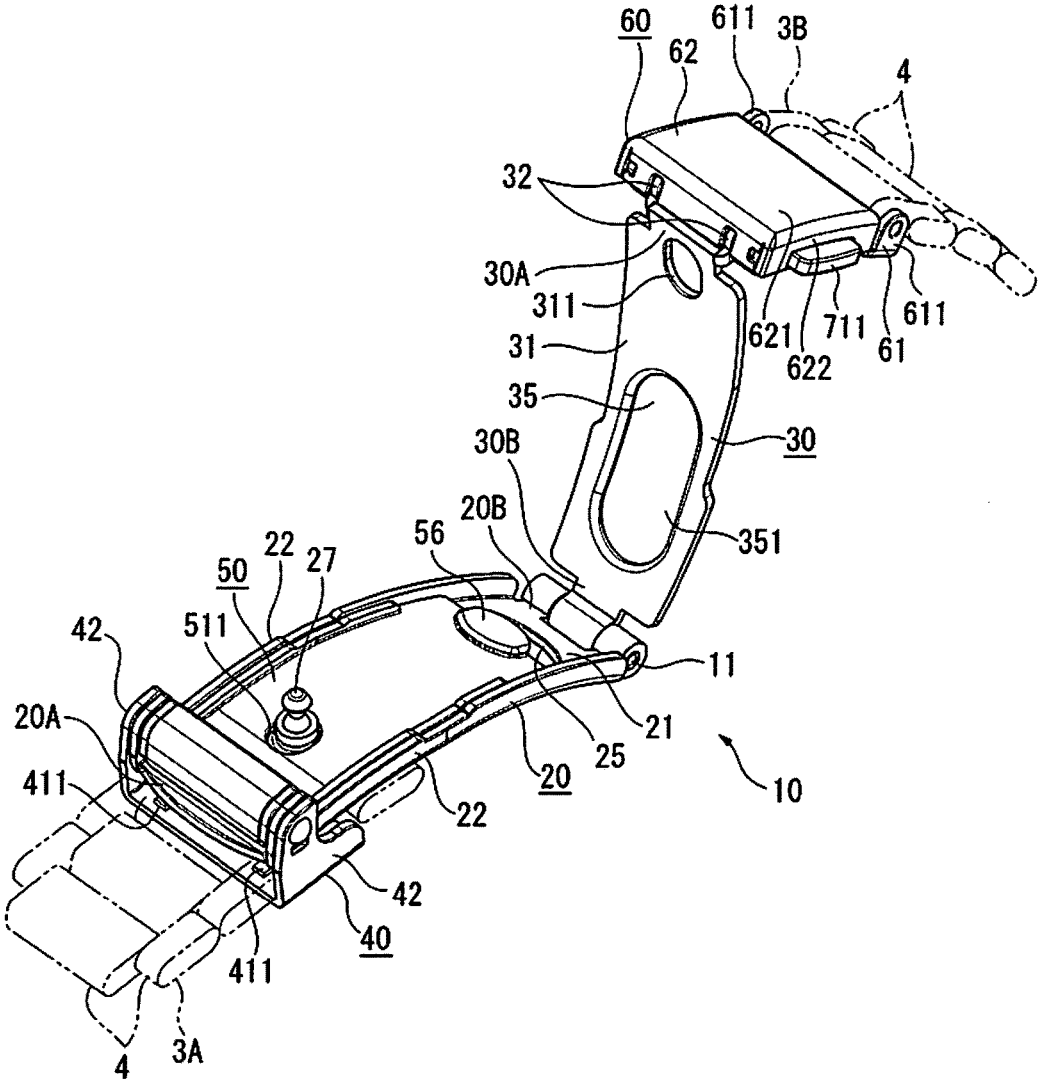
FIG. 5 is a perspective view illustrating the clasp of the embodiment.
Figure 6:
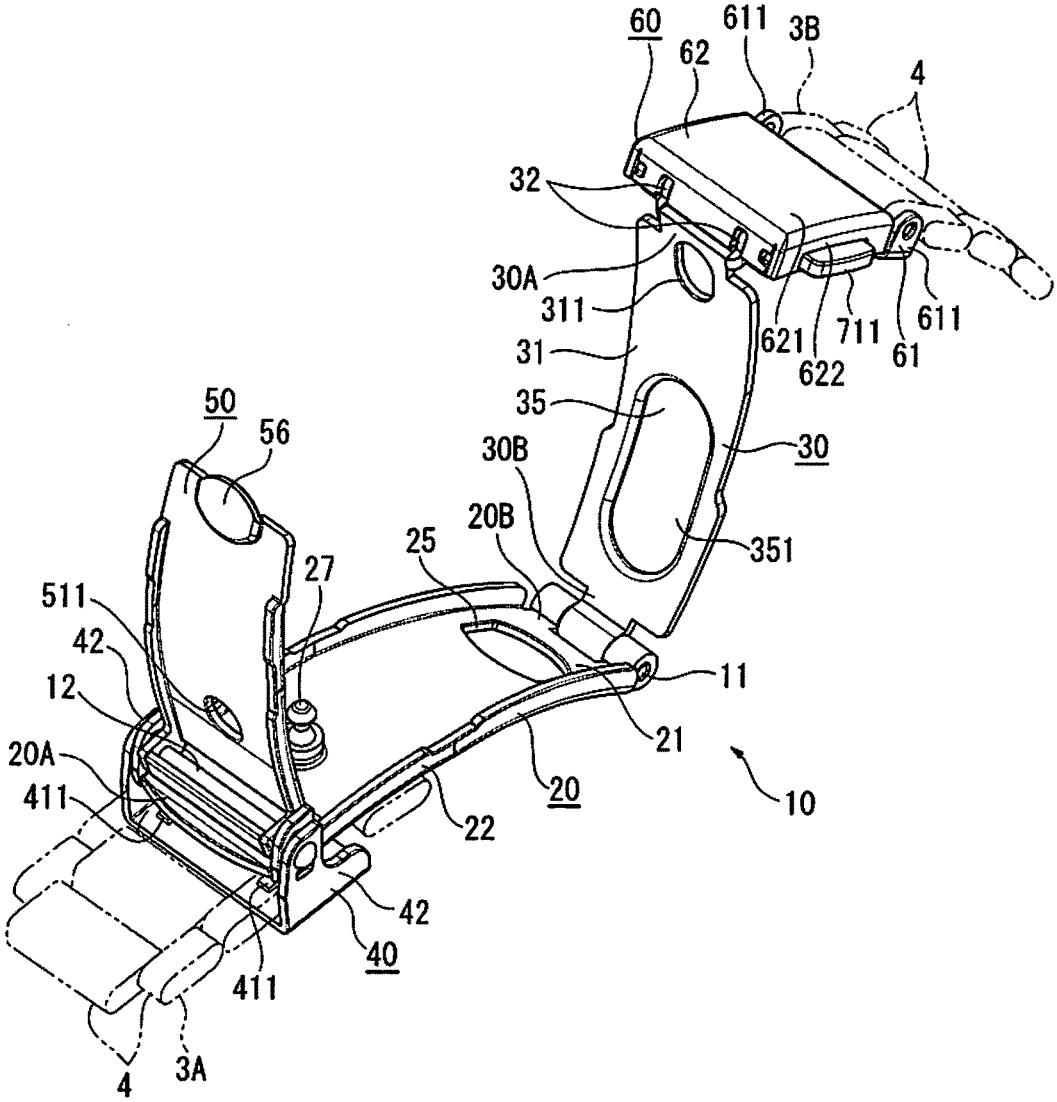
FIG. 6 is a perspective view illustrating a state where a lock member of the embodiment is pivoted to an unlock position.

As illustrated in FIGS. 5 and 6, the clasp 10 includes a lower holding member 20, an upper holding member 30, a lifting member 40, a lock member 50, and a main cover 60. In the embodiment, the lower holding member 20 and the upper holding member 30 are pivotably interlocked with each other by an interlock pin 11. The upper holding member 30 and the main cover 60 are pivotably interlocked with each other by an interlock pin (not illustrated). The main cover 60 is pivotably interlocked with the second band 3B. The lower holding member 20 is interlocked with the first band 3A by the lifting member 40 and the lock member 50 in a positionally adjustable manner.

Figure 2:
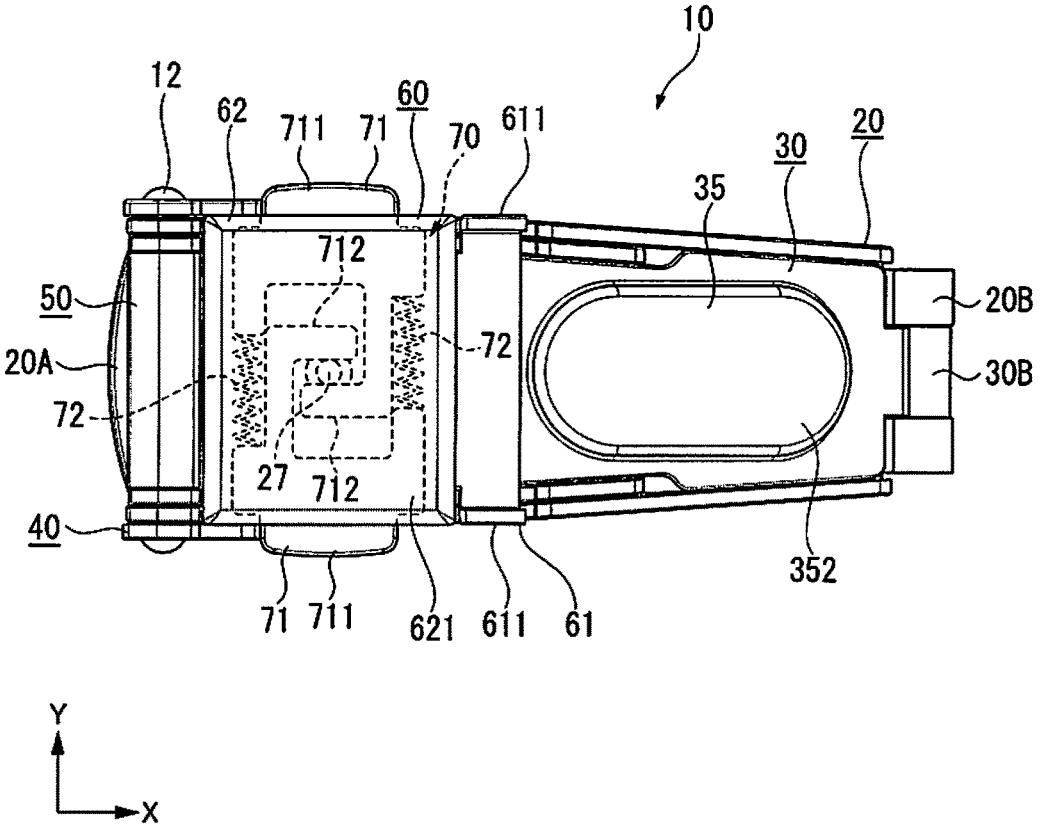
FIG. 2 is a top view illustrating a clasp used in the watch band of the embodiment.
Figure 3:
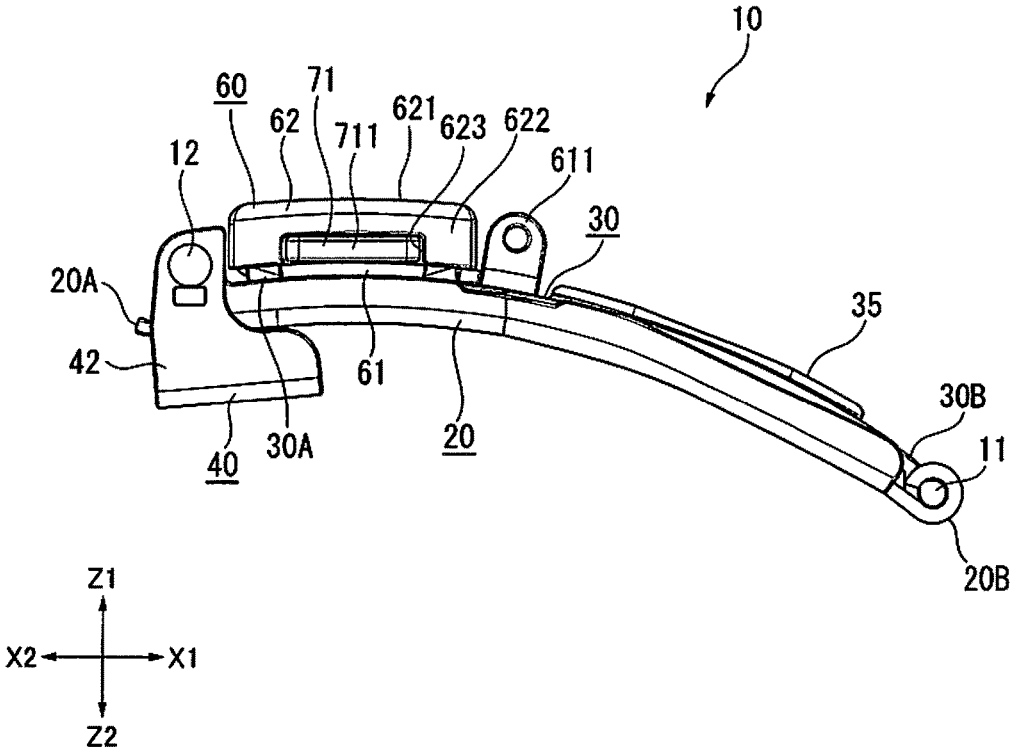
FIG. 3 is a side view illustrating the clasp of the embodiment.
Figure 4:
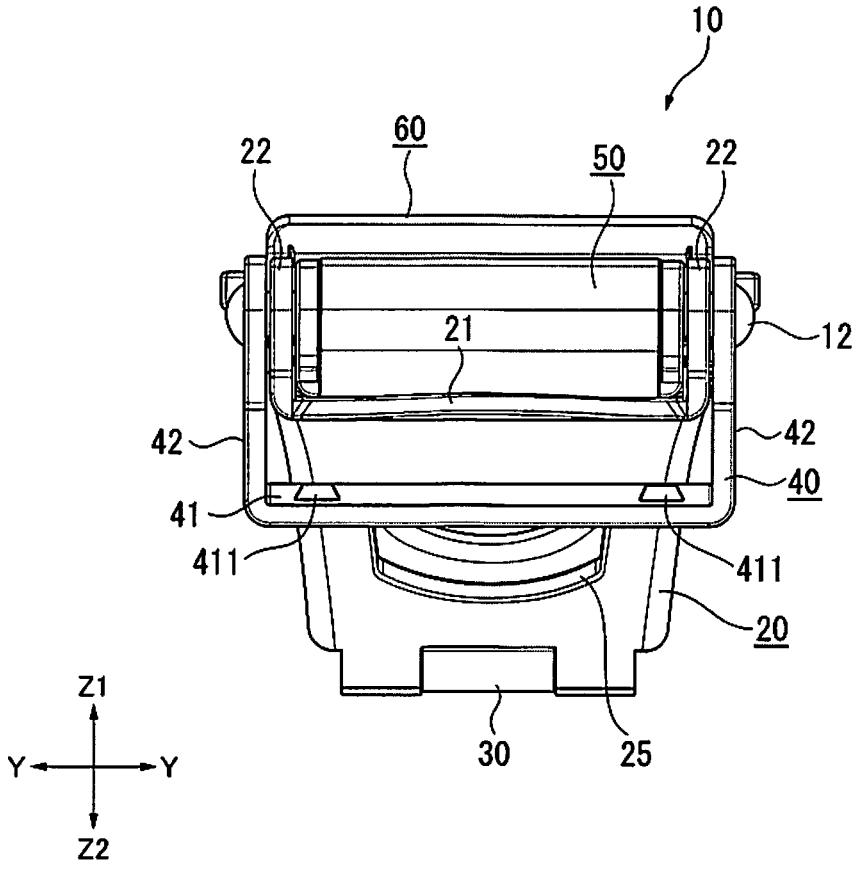
FIG. 4 is a front view illustrating the clasp of the embodiment.

As illustrated in FIGS. 2 to 4, a direction in which the lower holding member 20, the upper holding member 30, and the main cover 60 interlocking the first band 3A and the second band 3B with each other are arranged will be referred to as an X-direction. A direction along a band width direction of the first band 3A and the second band 3B will be referred to as a Y-direction. Moreover, a direction in which the lower holding member 20, the upper holding member 30, and the main cover 60 overlap each other will be referred to as a Z-direction. A direction from the lower holding member 20 toward the upper holding member 30 will be referred to as a Z1-direction, and the opposite direction will be referred to as a Z2-direction.

Moreover, as illustrated in FIGS. 3 and 5, in the lower holding member 20 and the upper holding member 30, sides close to the bands 3A and 3B will be respectively referred to as proximal end portions 20A and 30A, and end portions pivotably interlocked with each other by the interlock pin 11 will be respectively referred to as distal end portions 20B and 30B. A direction from the proximal end portion 20A to the distal end portion 20B will be referred to as an X1-direction, and the opposite direction will be referred to as an X2-direction.

Lower Holding Member

As illustrated in FIGS. 5 to 6, the lower holding member 20 includes a lower plate portion 21 which is curved along the X-direction from the proximal end portion 20A toward the distal end portion 20B, and a pair of side plate portions 22 which are respectively erected from side surfaces of the lower plate portion 21.

Figure 7:
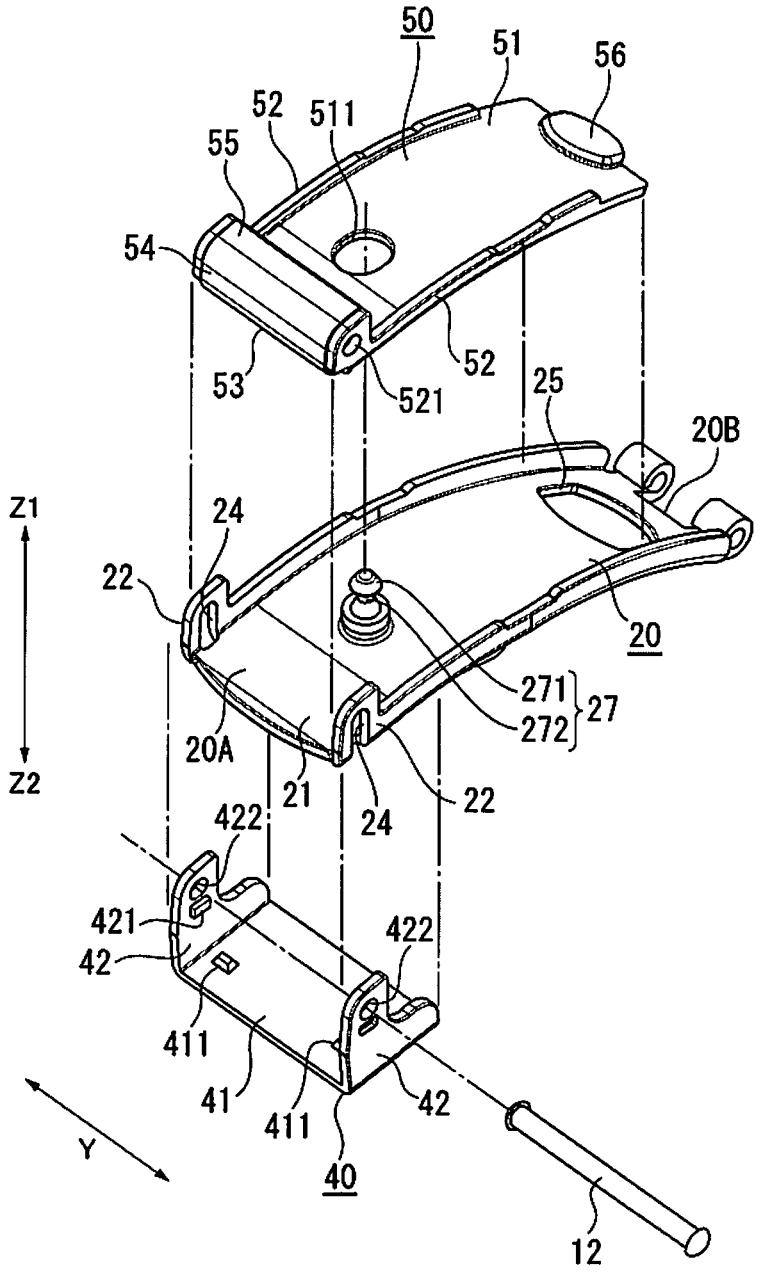
FIG. 7 is an exploded perspective view illustrating a lower holding member, a lifting member, and the lock member.

As illustrated in FIG. 7, a guide groove 24 which is a hole elongated along the Z1-direction is formed in a position close to the proximal end portion 20A in each of the side plate portions 22.

A penetration hole 25 penetrating the lower plate portion 21, and a lock pin 27 protruding from the lower plate portion 21 are formed in the lower plate portion 21.

The penetration hole 25 is formed close to the distal end portion 20B of the lower plate portion 21. An opening of the penetration hole 25 is formed so as to include two linear portions along the X-direction of the lower plate portion 21, a circular arc portion causing end portions of the linear portions on the proximal end portion 20A side to be interlocked with each other, and another circular arc portion causing end portions of the linear portions on the distal end portion 20B side to be interlocked with each other, thereby having a substantially barrel shape. However, the shape of the opening of the penetration hole 25 may be a circular shape, an elliptical shape, a rectangular shape, or the like.

The lock pin 27 is disposed close to the proximal end portion 20A of the lower plate portion 21. The lock pin 27 includes a conical head portion 271 and a shaft portion 272. The head portion 271 has a configuration in which the tip thereof has the same diameter as the shaft portion 272 and the diameter increases from the tip toward the shaft portion 272. As described below, the lock pin 27 engages with a lock mechanism of the main cover 60.

Upper Holding Member

As illustrated in FIGS. 5 and 6, the upper holding member 30 includes an upper plate portion 31 which is curved in a manner similar to that of the lower plate portion 21 of the lower holding member 20, and a pair of interlock plate portions 32 which are erected in the end portion of the upper plate portion 31 on the proximal end portion 30A side.

The width of the upper plate portion 31 is set so as to match the dimensions between the side plate portions 22 of the lower plate portion 21.

A bead 35 is processed in the upper plate portion 31. The bead 35 is elongated along the longitudinal direction of the upper plate portion 31. The bead 35 is formed through pressing. The bead 35 of the upper plate portion 31 becomes a recessed portion 351 which is recessed when viewed from a surface on the lower plate portion 21 side and becomes a protruding portion 352 which is protruding when viewed from a surface on the main cover 60 side. The bead 35 reinforces the upper plate portion 31 and is set to have a width and a length such that a projection portion 56 of the lock member 50 (will be described later) can be disposed in the recessed portion 351. An insertion hole 311 allowing the lock pin 27 to be inserted therethrough is also formed in the upper plate portion 31.

Accordingly, when a user folds the clasp 10 by causing the upper holding member 30 to overlap the lower holding member 20, the upper plate portion 31 is disposed between the side plate portions 22 of the lower plate portion 21. The projection portion 56 of the lock member 50 is disposed inside the recessed portion 351, and the upper plate portion 31 is in close contact with the lower plate portion 21. The lock pin 27 is disposed so as to be inserted through the insertion hole 311.

As described below, holes allowing interlock pins (not illustrated) for interlocking with respect to the main cover 60 are respectively formed in the pair of interlock plate portions 32.

Lifting Member

As illustrated in FIG. 7, the lifting member 40 is configured to include a bottom plate portion 41, and a pair of guide portions 42 which are respectively erected from side surfaces of the bottom plate portion 41.

The bottom plate portion 41 is disposed so as to face the lower plate portion 21 of the lower holding member 20. Two positioning projections 411 protruding from a surface on the lower plate portion 21 side are formed in the bottom plate portion 41 so as to be separated from each other in the band width direction (the Y-direction). Each positioning projection 411 is disposed in a gap between the band pieces 4 of the first band 3A. The positioning projections 411 adjust the attachment position of the lifting member 40 with respect to the first band 3A by the unit of the band piece 4.

The pair of guide portions 42 are respectively disposed outside the pair of side plate portions 22 of the lower plate portion 21. A guide projection 421 protruding toward the side plate portion 22 side is formed on a surface of each guide portion 42 on the side plate portion 22 side. A holding hole 422 allowing a guide pin 12 to be attached therethrough is formed in each of the guide portions 42. The guide projections 421 are respectively disposed inside guide grooves 24, and the guide pin 12 is inserted through the guide groove 24.

Since the guide grooves 24 are holes elongated along the Z1-direction, the guide pin 12 and the guide projections 421 can also move along the Z1-direction. Therefore, the lifting member 40 is attached to the lower holding member 20 so as to be movable in the Z1-direction (hereinafter, will be also referred to as the lifting direction) in which the bottom plate portion 41 approaches the lower plate portion 21, and the Z2-direction (a direction toward the opposite side of the Z1-direction, and hereinafter, will be also referred to as the lowering direction) in which the bottom plate portion 41 is separated from the lower plate portion 21.

Lock Member

As illustrated in FIG. 7, the lock member 50 is configured to include a plate portion 51 serving as an operation portion, a pair of side wall portions 52, a pressurizing portion 53 (refer to FIG. 8), a proximal end side cover portion 54, and a front surface side cover portion 55.

The pair of side wall portions 52 are respectively erected from side surfaces of the plate portion 51. The pressurizing portion 53 is formed so as to be bent from the end portion of the plate portion 51. The proximal end side cover portion 54 is formed so as to continue from the pressurizing portion 53, and the front surface side cover portion 55 is formed so as to continue from the proximal end side cover portion 54.

A hole 521 allowing the guide pin 12 to be inserted therethrough is formed in each of the side wall portions 52. Therefore, the lock member 50 is pivotably attached to the lower holding member 20 via the guide pin 12.

An insertion hole 511 allowing the lock pin 27 to be inserted therethrough is formed in the plate portion 51. The lock member 50 is configured to be able pivot until the plate portion 51 is in a close contact state with the lower plate portion 21. As illustrated in FIG. 5, when the plate portion 51 is in a close contact state with the lower plate portion 21, the lock member 50 is in the lock position.

In the plate portion 51, the projection portion 56 is integrally formed in a distal end portion on a side opposite to a proximal end portion pivoting on the guide pin 12. The projection portion 56 has a width smaller than that of the plate portion 51, and the planar shape thereof is a substantially barrel shape. The projection portion 56 continues from the plate portion 51 via a step portion and is disposed on the upper holding member 30 side beyond the plate portion 51 in the Z1-direction. The projection portion 56 protrudes beyond the plate portion 51 in the X1-direction.

The width of the plate portion 51 is set in accordance with the dimensions between the side plate portions 22. When the lock member 50 is pivoted to the lock position and the plate portion 51 is pivoted to a position so as to be in contact with the lower plate portion 21, the projection portion 56 provided on a distal end side of the plate portion 51 is set so as to overlap the penetration hole 25. Accordingly, when the rear surface side of the projection portion 56 is pressed by inserting a finger or a nail into the penetration hole 25 or inserting a pin or the like through the penetration hole 25, the projection portion 56 in the lock position can be raised and the plate portion 51 can be easily pivoted.

In a case where the lock member 50 is moved in the lock position, the proximal end side cover portion 54 hides a gap portion between the pair of side plate portions 22 on the proximal end portion 20A side. The front surface side cover portion 55 hides a gap portion between the pair of side plate portions 22 on an upper end portion side. Accordingly, the proximal end side cover portion 54 and the front surface side cover portion 55 can also hide the guide pin 12.

Figure 8:
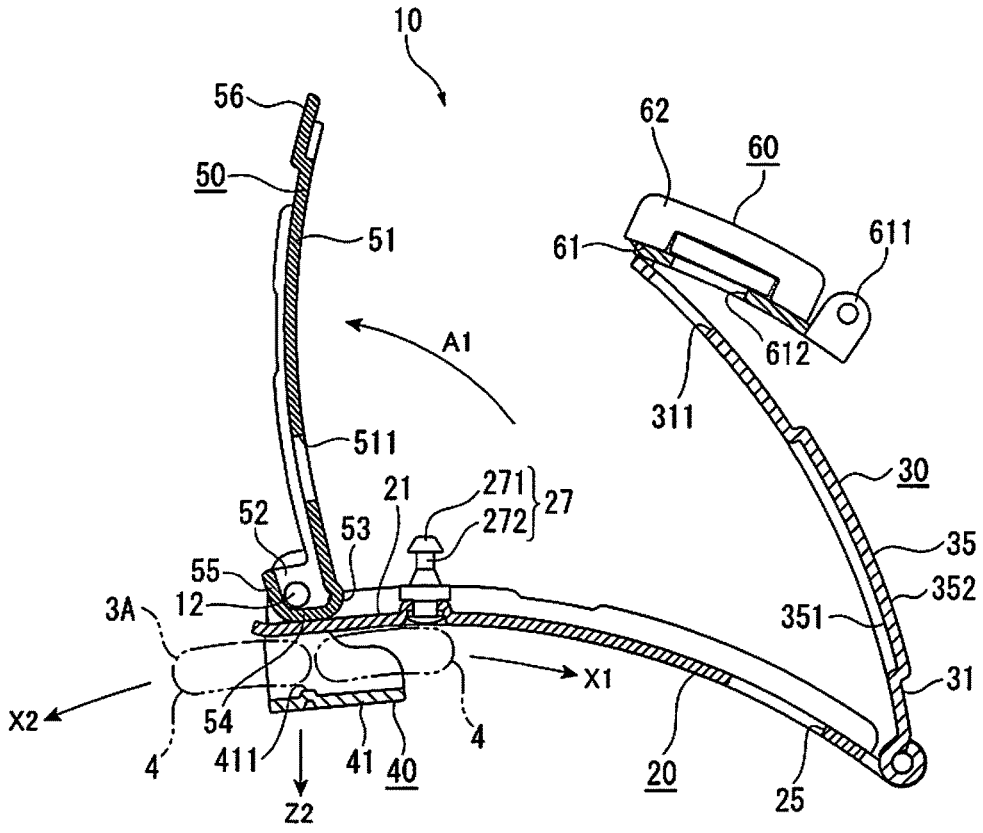
FIG. 8 is a side view illustrating a state where the lock member is pivoted to the unlock position.

As illustrated in FIGS. 7 to 10, in the lock member 50, the length from the hole 521 (the guide pin 12) to the pressurizing portion 53 is set so as to be longer than the length from the hole 521 to the proximal end side cover portion 54. Therefore, as illustrated in FIG. 8, in a state where the lock member 50 is raised and is pivoted in a direction of being separated from the lower plate portion 21 (A1-direction), the lock member 50 and the lifting member 40 can be moved in the lowering direction (the Z2-direction) to a position where the proximal end side cover portion 54 comes into contact with the lower plate portion 21. Therefore, the dimensions between the bottom plate portion 41 of the lifting member 40, and the lower plate portion 21 become greater than the thickness of the band piece 4. Therefore, the first band 3A inserted through a gap between the bottom plate portion 41 and the lower plate portion 21 can move in the X1-direction and the X2-direction.

Figure 9:
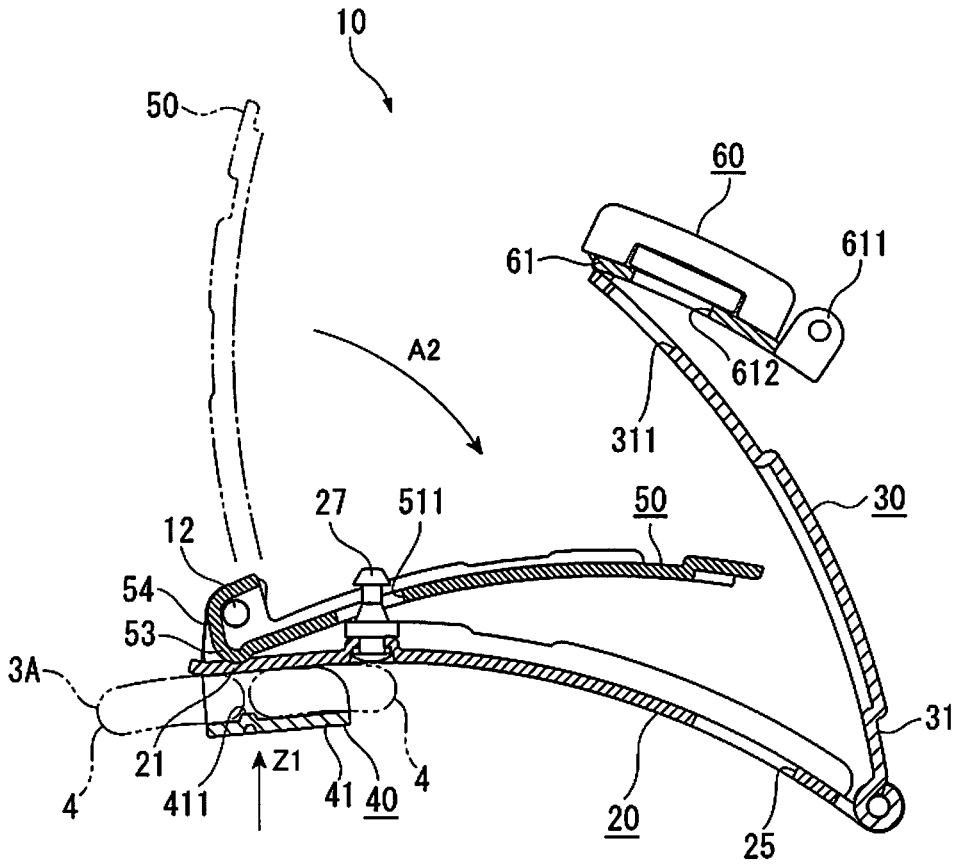
FIG. 9 is a side view illustrating a state of the lock member in the middle of pivoting from the unlock position to a lock position.
Figure 10:
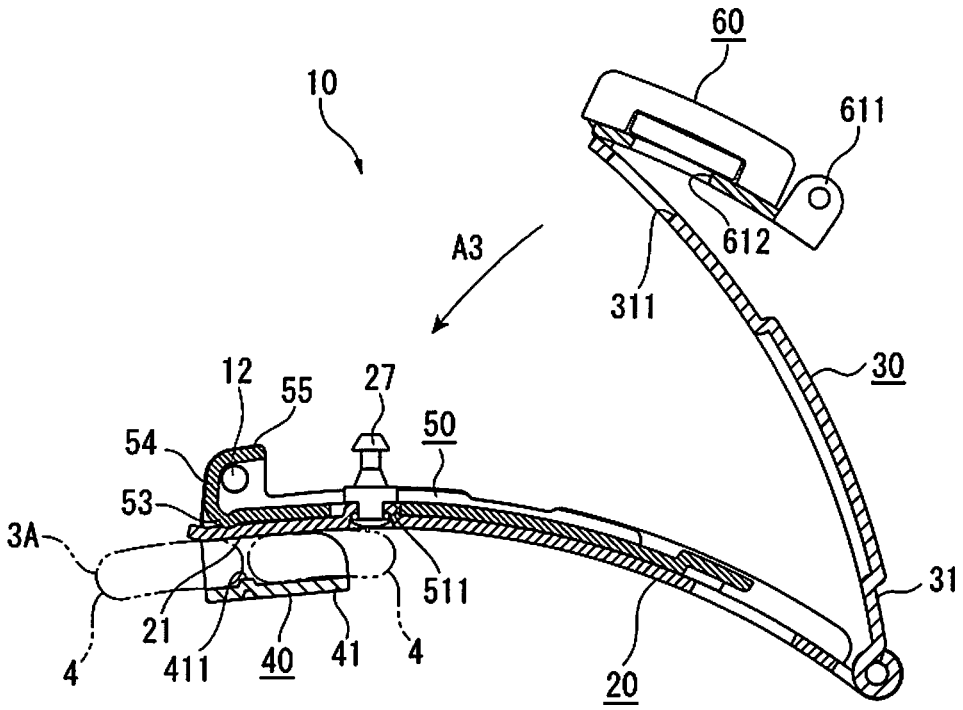
FIG. 10 is a side view illustrating a state where the lock member is pivoted to the lock position.

Meanwhile, as illustrated in FIG. 9, when the lock member 50 is pivoted toward the lower plate portion 21 side (A2-direction) and is pushed down, the pressurizing portion 53 comes into contact with the lower plate portion 21. Therefore, the guide pin 12 inserted through the insides of the guide grooves 24 moves in the Z1-direction of being separated from the lower plate portion 21, and the lifting member 40 to which the guide pin 12 is attached also moves in the Z1-direction (the lifting direction). Therefore, the bottom plate portion 41 of the lifting member 40 approaches the lower plate portion 21, and the dimensions between the bottom plate portion 41 of the lifting member 40, and the lower plate portion 21 become approximately the same as the thickness of the band piece 4. In this case, the positioning projections 411 of the bottom plate portion 41 enter between the band pieces 4, and the first band 3A is attached between the bottom plate portion 41 and the lower plate portion 21 so as to be immovable in the X1-direction and the X2-direction. In other words, the attachment position of the lower holding member 20 with respect to the first band 3A is determined. As illustrated in FIG. 10, the state is also maintained in a case where the lock member 50 is pivoted to the lock position.

Main Cover

As illustrated in FIG. 5, the main cover 60 includes a plate 61 and a cover 62 and is formed so as to have a box shape.

As illustrated in FIG. 2, a lock mechanism 70 is accommodated inside the main cover 60. As illustrated in FIGS. 5 and 8, a pair of support portions 611 are formed in the plate 61 in a bent manner, and penetration holes allowing a spring rod used for interlocking with respect to the second band 3B to be inserted therethrough are respectively formed in the support portions 611. The plate 61 includes groove portions in which the interlock plate portions 32 are disposed, and support portions which are formed on both sides of the groove portion in a bent manner (not illustrated). An interlock pin for interlocking with respect to the upper holding member 30 is inserted through each of the interlock plate portions 32, and both ends of the interlock pin are restricted by the support portion from moving, thereby being prevented from coming off. The interlock plate portions 32, the support portions, and the interlock pins are accommodated inside the cover 62.

As illustrated in FIG. 8, an opening 612 allowing the lock pin 27 to be inserted therethrough is formed on a surface at a central portion of the plate 61.

As illustrated in FIGS. 2 and 3, the cover 62 includes a substantially rectangular top surface 621, and wall portions 622 which are integrally formed so as to surround the top surface 621. When the lower holding member 20 and the upper holding member 30 of the clasp 10 are folded, the top surface 621 of the cover 62 is disposed between the first band 3A and the second band 3B, thereby being visually recognizable from the outside.

In the cover 62, cut-offs 623 are respectively formed in the two wall portions 622 facing each other in the band width direction (the Y-direction), and an operation portion 711 of a slide member 71 configuring the lock mechanism 70 protrudes in each of the wall portions 622.

As illustrated in FIG. 2, the lock mechanism 70 includes a pair of the slide members 71, and coil springs 72 respectively biasing the slide members 71.

The slide members 71 are provided so as to be formed with members having the same shape and face each other in the Y-direction. Each of the slide members 71 is configured to include the operation portion 711 formed in an outer end portion in the Y-direction, and a latch portion 712 latching the lock pin 27 of the lower holding member 20.

The operation portion 711 protrudes outward through the cut-off 623. A user of the wristwatch can slidably move the slide members 71 by operating the operation portions 711.

The planar shape of the latch portion 712 in its entirety is formed to be a substantial L-shape. A pair of the latch portions 712 are disposed in a symmetrically engaged manner and are disposed at a substantial center while facing each other in the Y-direction. When the slide members 71 move, the latch portions 712 approach each other and are separated from each other in accordance with the slide motion. In the latch portions 712 of a pair of the slide members 71, surfaces facing each other are inclined surfaces.

Here, when a user folds the lower holding member 20 and the upper holding member 30, and thrusts the main cover 60 toward the side of the lower holding member 20 and the upper holding member 30, the lock pin 27 is inserted between the latch portions 712 through the opening 612 of the main cover 60. Then, the tip of the head portion 271 of the lock pin 27 comes into contact with the inclined surfaces of the latch portions 712. Therefore, the pair of slide members 71 move against biasing force of the coil springs 72, and the latch portions 712 are separated from each other.

Moreover, when a user thrusts the main cover 60 toward the lower holding member 20 side, the head portion 271 of the lock pin 27 passes by the latch portions 712, and the shaft portion 272 of the lock pin 27 is positioned between the latch portions 712. Then, the slide members 71 move due to the biasing force of the coil springs 72, and the latch portions 712 approach each other. Therefore, the head portion 271 of the lock pin 27 is latched on the latch portions 712, and the lock mechanism 70 of the main cover 60 and the lock pin 27 are maintained in an engaged state.

Subsequently, an operation of adjusting the attachment position of the clasp 10, that is, an operation of adjusting the length of the watch band 3 will be described.

First, as illustrated in FIG. 8, a user of the wristwatch 1 causes the lock member 50 to pivot in a direction of being separated from the lower plate portion 21 (the A1-direction in FIG. 8) and to be raised such that the proximal end side cover portion 54 is in a state of facing the lower plate portion 21. Here, the length from the guide pin 12 to the proximal end side cover portion 54 is shorter than the dimensions to the pressurizing portion 53. Therefore, when the proximal end side cover portion 54 is moved to a position so as to be in contact with the lower plate portion 21, the lifting member 40 also moves in the Z2-direction, and thus, the dimensions of a gap between the lower plate portion 21 and the bottom plate portion 41 increase. The dimensions from the lower plate portion 21 to the positioning projection 411 become greater than the thickness of the band piece 4, and thus, the first band 3A can be moved in the X1-direction and the X2-direction in FIG. 8. Accordingly, the attachment position of the lower holding member 20 with respect to the first band 3A, that is, the attachment position of the clasp 10 can be adjusted, and the effective length of the watch band 3 can be adjusted.

Subsequently, a user causes the lock member 50 to pivot in a direction approaching the lower plate portion 21 (the A2-direction in FIG. 9). The pressurizing portion 53 comes into contact with the lower plate portion 21 in accordance with pivoting of the lock member 50. Accordingly, the guide pin 12 inserted through the insides of the guide grooves 24 moves in the Z1-direction of being separated from the lower plate portion 21, and the lifting member 40 to which the guide pin 12 is attached also moves in the Z1-direction. Therefore, the bottom plate portion 41 of the lifting member 40 approaches the lower plate portion 21, and the dimensions between the bottom plate portion 41 of the lifting member 40, and the lower plate portion 21 become approximately the same as the thickness of the band piece 4. In this case, the positioning projections 411 of the bottom plate portion 41 enter between the band pieces 4. Accordingly, the first band 3A is held between the bottom plate portion 41 and the lower plate portion 21, thereby being immovable.

As illustrated in FIG. 10, the first band 3A is positioned between the bottom plate portion 41 and the lower plate portion 21 by causing the lock member 50 to pivot to the lock position such that the lock member 50 comes into contact with the lower plate portion 21.

In other words, the bottom plate portion 41 of the lifting member 40 can approach the lower plate portion 21 or can be separated from the lower plate portion 21 by causing the lock member 50 to pivot. Therefore, a user of the wristwatch 1 can easily adjust the attachment position of the clasp 10 with respect to the first band 3A.

Subsequently, a locking/unlocking operation of the clasp 10 will be described.

As illustrated in FIGS. 5 and 10, in order to lock the clasp 10, the lock member 50 is caused to come into contact with the lower plate portion 21, and the lock pin 27 is caused to be in a state of protruding through the insertion hole 511 of the lock member 50. A user moves the upper holding member 30 and the main cover 60 in an A3-direction in FIG. 10 and folds the lower holding member 20, the upper holding member 30, and the main cover 60. Then, the lock pin 27 is inserted through the insertion hole 311 of the upper plate portion 31 of the upper holding member 30 and is further inserted into the opening 612 of the main cover 60. Then, the slide members 71 of the lock mechanism 70 illustrated in FIG. 2 are pressed and spread by the head portion 271 of the lock pin 27. When the head portion 271 passes by the latch portions 712 of the slide members 71, the slide members 71 move to the shaft portion 272 side of the lock pin 27 due to the coil springs 72 and latch the lock pin 27. Accordingly, the lock mechanism 70 of the clasp 10 is locked.

Meanwhile, in order to unlock the lock mechanism 70 of the clasp 10, a user presses the operation portions 711 and widens a gap between the latch portions 712 of the slide members 71, thereby releasing the engaged state with respect to the lock pin 27. While the user is pressing the operation portions 711, the main cover 60 is lifted and the upper holding member 30 is separated from the lower holding member 20. Then, the lock pin 27 is detached from the opening 612 of the main cover 60 and the insertion hole 311 of the upper plate portion 31, and thus, the lock mechanism 70 can be released.

Accordingly, the lower holding member 20 and the upper holding member 30 are in a widened state from a folded state, and thus, the watch band 3 can be put on or taken off the wrist of the user.

Effect of Embodiment

According to the embodiment described above, a mechanism in which the clasp 10 is attached to the first band 3A in a positionally adjustable manner can be configured to include the lower holding member 20, the lifting member 40, and the lock member 50. Moreover, a mechanism for locking/unlocking the clasp 10 can be configured to include the lock mechanism 70 provided in the main cover 60, and the lock pin 27 of the lower holding member 20. Therefore, it is not necessary to collectively provide the mechanisms in one main body portion. Thus, the structure of the clasp 10 can be simplified, the number of components can be reduced, and the clasp 10 can be reduced in weight.

Positional adjustment of the clasp 10 with respect to the first band 3A can be performed through an operation in which the lock member 50 is pivoted. The operation of positional adjustment is independent from an operation of opening/closing the clasp 10, in which the upper holding member 30, the lower holding member 20, and the main cover 60 are folded or opened. Therefore, during the opening/closing operation, the first band 3A is not unlocked due to pivoting of the lock member 50. Thus, the clasp 10 can be reliably fixed to the first band 3A.

In the lock member 50, since a state where the plate portion 51 is in contact with the upper holding member 30 is set as the locked state, the locked state can be stably maintained. In addition, since the clasp 10 is covered with the upper holding member 30 and the main cover 60 while being locked, the lock member 50 does not move to the unlock position when the lock mechanism 70 is locked. Thus, the locked state can be reliably maintained.

A mechanism for positioning and fixing the first band 3A can be configured by inserting the guide pin 12 through the pair of guide portions 42 of the lifting member 40, the pair of side plate portions 22 of the lower holding member 20, and the lock member 50. Therefore, the clasp 10 can be assembled by only causing the guide pin 12 to pass through the three members. Thus, assembling workability of the clasp 10 can be improved.

The pressurizing portion 53 can be brought into contact with the lower plate portion 21 by causing the plate portion 51 provided in the lock member 50 to pivot to the lock position. Accordingly, the guide pin 12 and the lifting member 40 can move in the lifting direction (the Z1-direction), and the first band 3A can be positioned and fixed while being interposed between the lifting member 40 and the lower holding member 20. Therefore, the configuration of the lock member 50 can be simplified, and the manufacturing cost can also be reduced. Moreover, the first band 3A can be positioned and fixed or can be positionally adjusted by only causing the plate portion 51 of the lock member 50 to pivot between the lock position and the unlock position. Thus, adjusting operability of the effective length of the band can be improved.

Since the positioning projections 411 are formed in the bottom plate portion 41 of the lifting member 40, the positioning projections 411 can be disposed between the band pieces 4 when the first band 3A is interposed between the lifting member 40 and the lower holding member 20. Thus, the first band 3A can be reliably restricted from moving with respect to the clasp 10.

Since the guide projections 421 are respectively formed in the guide portions 42 of the lifting member 40, the guide projections 421 and the guide pin 12 can be disposed inside the guide grooves 24 of the side plate portions 22. Thus, when the lock member 50 is pivoted, the lifting member 40 can be prevented from pivoting in association with the lock member 50, and the lifting member 40 can be smoothly moved in the lifting direction (the Z1-direction) and the lowering direction (the Z2-direction).

Since the penetration hole 25 is formed in the lower holding member 20 and the projection portion 56 partially covers the penetration hole 25 when the lock member 50 overlaps the lower holding member 20, the projection portion 56 of the lock member 50 is exposed through the penetration hole 25. Therefore, the projection portion 56 can be easily raised by inserting a finger or a nail into the penetration hole 25, or the lock member 50 can be easily operated so as to pivot by inserting a pin or the like through the penetration hole 25 and pressing the rear surface side of the projection portion 56. Particularly, since the penetration hole 25 is formed on the distal end portion 20B side of the lower holding member 20, and the projection portion 56 of the lock member 50 is also formed in a position separated from the guide pin 12 which is a pivot axis of the lock member 50, the lock member 50 can be pivoted with small force when the projection portion 56 is raised. Moreover, since the projection portion 56 is formed in a position separated from the lock pin 27 on the proximal end portion 20A side, a finger can be prevented from being bumped into the lock pin 27 when a pivoting operation of the lock member 50 is performed.

Since the bead 35 is formed in the upper holding member 30, rigidity of the upper plate portion 31 can be improved. Moreover, since the recessed portion 351 in which the projection portion 56 can be disposed is formed in the upper holding member 30, a gap can be prevented from being generated when the lower holding member 20 and the upper holding member 30 overlap each other due to pivoting. Thus, rigidity of the clasp 10 can be improved.

An unlocking operation of the clasp 10 can be performed by only separating the main cover 60 from the lower holding member 20 while the operation portions 711 are in a thrust state. The clasp 10 can be unlocked through a simple operation. Moreover, when the clasp 10 is widened, the first band 3A, the lower holding member 20, the upper holding member 30, the main cover 60, and the second band 3B are continuously arranged. Thus, the open length of the watch band 3 can be increased, and the wristwatch 1 can be easily put on or taken off the wrist.

A locking operation of the clasp 10 can be performed by only moving the main cover 60 toward the lower holding member 20 side and causing the lock mechanism 70 to be thrust into the lock pin 27 and to be locked therein. The clasp 10 can be locked through a simple operation.

Other Embodiments

The invention is not limited to the above-described embodiment. The invention includes changes, improvements, and the like within the scope in which the advantages of the invention can be achieved.

The clasp of the invention is not limited to the watch band. For example, the clasp can also be utilized in accessories. Here, as the accessories, a bracelet, a necklace, a belt, a band, a choker worn around the neck, a fastener of clothes, and the like can be exemplified. Moreover, the clasp of the invention can also be applied to various types of goods such as shoes, bags, and footwear.

The bead 35 does not have to be formed in the upper holding member 30, and the penetration hole 25 does not have to be formed in the lower holding member 20. The lock mechanism 70 is not limited to that in the embodiment. In other words, the configurations of the lower holding member 20, the upper holding member 30, the lifting member 40, the lock member 50, the main cover 60, and the lock mechanism 70 may be changed within the scope in which the advantages of the invention can be achieved, without being limited to those in the embodiment.

The entire disclosure of Chinese Patent Application No. 201610064468.6, filed Jan. 29, 2016 is expressly incorporated by reference herein.

What is claimed is:

1. A clasp configured to interlock a first band and a second band with each other, the clasp comprising:

a lower holding member in which a lock pin is fixed;

an upper holding member which is pivotably interlocked with the lower holding member;

a lifting member which is slidably attached to the lower holding member, with the lifting member being slidable relative to the lower holding member between a hold position in a lifting direction approaching the lower holding member for holding the first band in a spacing between the lifting member and the lower holding member and a release position in a lowering direction of being separated from the lower holding member for releasing the first band relative to the clasp, the spacing between the lifting member and the lower holding member being larger when the lifting member is in the release position than when the lifting member is in the hold position;

a lock member which is pivotably attached to the lower holding member with the lock member being pivotable between a lock position and an unlock position, the lock member moving the lifting member to the hold position in response to being pivoted to the lock position, the lock member moving the lifting member to the release position in response to being pivoted to the unlock position; and a main cover which includes a lock mechanism engaged with the lock pin in a state where the upper holding member and the lower holding member overlap each other due to pivoting, the main cover being pivotably interlocked with the upper holding member between the upper holding member and the second band.

2. The clasp according to claim 1, wherein the lower holding member has a penetration hole, and wherein the lock member overlaps the lower holding member and partially covers the penetration hole when being pivoted to the lock position.

3. A watch band comprising:

the clasp according to claim 2;

a first band which is positioned and fixed by the lower holding member and the lifting member of the clasp; and a second band which is interlocked with the main cover.

4. A watch comprising:

the watch band according to claim 3.

5. A watch band comprising:

the clasp according to claim 1;

a first band which is positioned and fixed by the lower holding member and the lifting member of the clasp; and a second band which is interlocked with the main cover.

6. A watch comprising:

the watch band according to claim 5.

7. A clasp causing a first band and a second band to be interlocked with each other, the clasp comprising:

a lower holding member in which a lock pin is fixed;

an upper holding member which is pivotably interlocked with the lower holding member;

a lifting member which is attached to the lower holding member so as to be able to move in a lifting direction approaching the lower holding member and a lowering direction of being separated from the lower holding member and guides the first band;

a lock member which is attached to the lower holding member so as to be able to pivot between a lock position and an unlock position and lifts the lifting member to the lower holding member side when being pivoted to the lock position so as to perform positioning and fixing of the first band while interposing the first band between the lifting member and the lower holding member; and a main cover which includes a lock mechanism engaged with the lock pin in a state where the upper holding member and the lower holding member overlap each other due to pivoting and is pivotably interlocked between the upper holding member and the second band, wherein the lower holding member includes a lower plate portion and a pair of side plate portions, and a guide groove extending along the lifting direction is formed in each of the side plate portions, wherein the lifting member includes a bottom plate portion which faces the lower plate portion, a pair of guide portions which are respectively disposed along the pair of side plate portions, and a guide pin which is inserted through each of the guide grooves and is attached to the pair of guide portions, and wherein the lock member includes an operation portion which is pivotably supported by the guide pin, and a pressurizing portion which comes into contact with the lower plate portion and lifts the lifting member in the lifting direction when the operation portion is pivoted to the lock position, and the pressurizing portion is configured to be separated from the lower plate portion such that the lifting member becomes movable in the lowering direction when the operation portion is pivoted to the unlock position.

8. The clasp according to claim 7, wherein the first band is configured to have a plurality of band pieces which are interlocked with each other, wherein a positioning projection protruding toward the lower plate portion is formed in the bottom plate portion of the lifting member, and wherein the positioning projection is disposed between the band pieces when the lock member is pivoted to the lock position and the first band is interposed between the lifting member and the lower holding member.

9. A watch band comprising:

the clasp according to claim 8;

a first band which is positioned and fixed by the lower holding member and the lifting member of the clasp; and a second band which is interlocked with the main cover.

10. A watch comprising:

the watch band according to claim 9.

11. The clasp according to claim 7, wherein a guide projection protruding toward the side plate portion is formed in each of the pair of guide portions of the lifting member, and wherein the lifting member moves in the lifting direction and the lowering direction while the guide projections are respectively guided in the guide grooves.

12. A watch band comprising:

the clasp according to claim 11;

a first band which is positioned and fixed by the lower holding member and the lifting member of the clasp; and a second band which is interlocked with the main cover.

13. A watch comprising:

the watch band according to claim 12.

14. A watch band comprising:

the clasp according to claim 7;

a first band which is positioned and fixed by the lower holding member and the lifting member of the clasp; and a second band which is interlocked with the main cover.

15. A watch comprising:

the watch band according to claim 14.

16. A clasp causing a first band and a second band to be interlocked with each other, the clasp comprising:

a lower holding member in which a lock pin is fixed;

an upper holding member which is pivotably interlocked with the lower holding member;

a lifting member which is attached to the lower holding member so as to be able to move in a lifting direction approaching the lower holding member and a lowering direction of being separated from the lower holding member and guides the first band;

a lock member which is attached to the lower holding member so as to be able to pivot between a lock position and an unlock position and lifts the lifting member to the lower holding member side when being pivoted to the lock position so as to perform positioning and fixing of the first band while interposing the first band between the lifting member and the lower holding member; and a main cover which includes a lock mechanism engaged with the lock pin in a state where the upper holding member and the lower holding member overlap each other due to pivoting and is pivotably interlocked between the upper holding member and the second band, wherein the lower holding member has a penetration hole, wherein the lock member has a projection portion which partially overlaps the penetration hole when being pivoted to the lock position, wherein the upper holding member has a recessed portion which is formed on a surface facing the lower holding member, and wherein the projection portion is disposed in the recessed portion when the lower holding member and the upper holding member overlap each other due to pivoting.

17. A watch band comprising:

the clasp according to claim 16;

a first band which is positioned and fixed by the lower holding member and the lifting member of the clasp; and a second band which is interlocked with the main cover.

18. A watch comprising:

the watch band according to claim 17.

* * * * *